US006544402B2

(12) United States Patent
Graf

(10) Patent No.: US 6,544,402 B2
(45) Date of Patent: Apr. 8, 2003

(54) METHOD AND APPARATUS FOR MANUFACTURING A WIRE

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 88 days.

(21) Appl. No.: 09/784,236

(22) Filed: Feb. 14, 2001

(65) Prior Publication Data

US 2001/0015323 A1 Aug. 23, 2001

(30) Foreign Application Priority Data

Feb. 18, 2000 (DE) ..... 100 07 567

(51) Int. Cl.[7] ..... B23H 11/00; C25F 1/00; C25F 7/00

(52) U.S. Cl. ..... 205/660; 205/661; 205/672; 204/206

(58) Field of Search ..... 205/660, 661, 205/672; 204/224 M, 206

(56) References Cited

U.S. PATENT DOCUMENTS 3,676,322 A 7/1972 Kamata et al.
3,740,324 A 6/1973 Lesher
3,816,273 A * 6/1974 Snyder ..... 205/661
4,395,320 A * 7/1983 Kasashima et al. ..... 204/206
4,612,084 A 9/1986 Schmolke
4,935,112 A * 6/1990 Stokes ..... 205/660
5,507,924 A * 4/1996 Mikumo et al. ..... 205/641

FOREIGN PATENT DOCUMENTS

DE 3332804 3/1985

OTHER PUBLICATIONS

Galvanotechnik 82, No. 7, 1991, pp. 2282 to 2297.

* cited by examiner

*Primary Examiner*—Donald R. Valentine
(74) *Attorney, Agent, or Firm*—Friedrich Kueffner

(57) ABSTRACT

A method and an apparatus for manufacturing a wire, particularly a sawtooth wire for all-steel sawtooth wire card clothings, wherein the surface of a wire-shaped intermediate product, such as a wire already provided with sawteeth, is smoothened in an electropolishing process in an electrolyte bath containing an electrolyte. A relative movement is produced between the electrolyte and the intermediate product during the electropolishing process. The apparatus includes a device for producing a relative movement between the electrolyte and the intermediate product contained in the electrolyte bath.

20 Claims, 1 Drawing Sheet

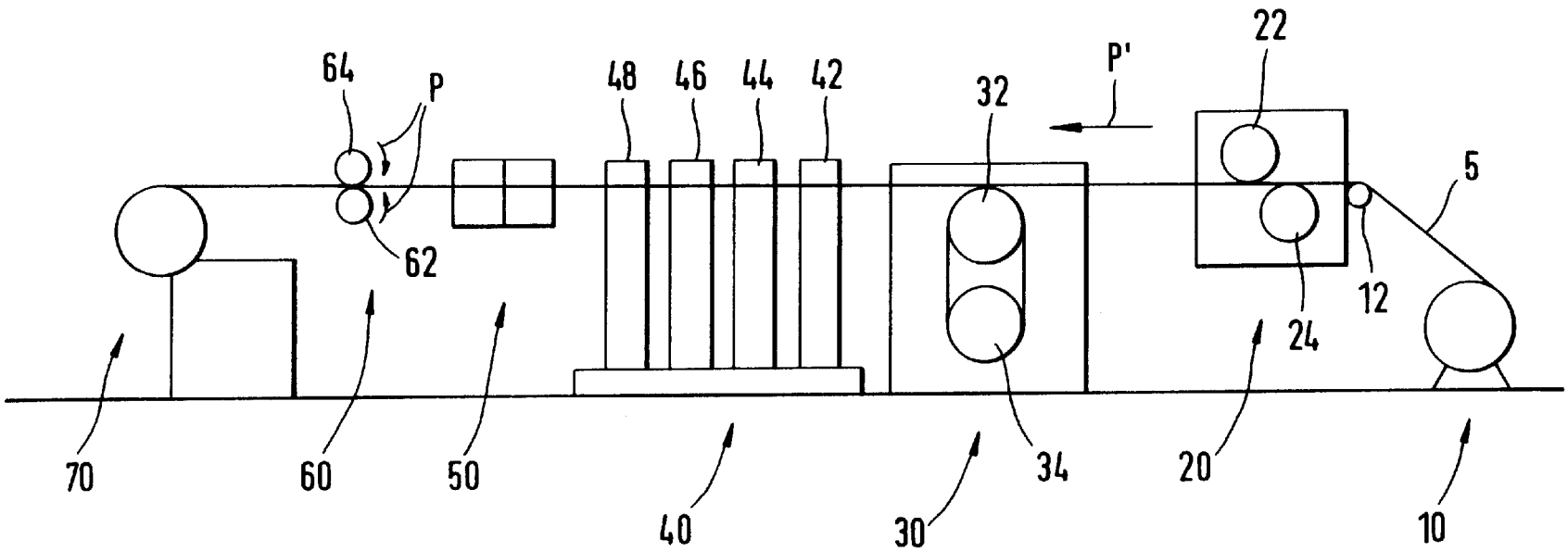
10
5
12
20
22
24
P'
30
32
34
40
42
44
46
48
50
60
62
64
P
70

METHOD AND APPARATUS FOR MANUFACTURING A WIRE

BACKGROUND OF THE INVENTION

1. Field of the Invention

The present invention relates to a method of manufacturing a wire, particularly sawtooth wire for all-steel sawtooth wire card clothings, in which the surface of a wire-shaped intermediate product, such as a wire already provided with sawteeth, is smoothened in an electropolishing process carried out in an electrolyte bath containing an electrolyte; the invention also relates to an apparatus suitable for carrying out such methods.

2. Description of the Related Art

All-steel sawtooth wire card clothings are used, for example, in processing textile fibers into yarns, non-woven fabrics, or the like. The individual sawtooth wires of the all-steel sawtooth wire card clothings usually have a height of less than 2 mm and a width in the area of the tooth tips of 0.2 mm or less. For manufacturing such fine sawtooth wires, a wire-shaped initial material is usually initially subjected to one or more drawing processes, wherein different heat treatment processes may be carried out between the individual drawing processes in order to provide the already drawn wire at least partially again with its deformability. Following this preparation, the wire is usually provided with sawteeth in an appropriate punching device. The sawteeth produced by the punching process may also be hardened prior to or following the punching process. After the punching process, small punched brows remain on the surface of the sawtooth wires. In addition, impurities caused by the preceding processing steps may adhere to the surfaces of the sawtooth wires, such as scale, i.e., oxide residues, or dirt residues produced during the thermal treatment.

These residues on the sawtooth wires are harmful when the sawtooth wires are later used for processing textile fibers, particularly when using high-capacity machines, because individual fibers may adhere to the card clothing teeth and the card clothing as a result has an increased tendency to fill with fibers and impurities, such as, for example, steel parts or the like. For avoiding these disadvantages, sawtooth wires intended for manufacturing all-steel sawtooth wire card clothings are usually additionally cleaned and polished after the punching or hardening process. For this purpose, usually an electrolytic polishing plant is used. In the electropolishing process carried out with such an electrolytic polishing plant, material is removed from the surface of the anodically switched wire-shaped intermediate product, such as the wire already provided with sawteeth and/or hardened wire, by using a usually material-specifically selected electrolyte and an external direct-current source. This material is dissolved by the electrolyte, wherein the removal takes place without mechanical load acting on the workpiece, i.e., the wire-shaped intermediate product, and leads to a smoothening or flattening of the workpiece surface. Consequently, the electropolishing process in principal is the reversal of the galvanizing process. In contrast to mechanical removal methods, the flattening achieved in this matter starts in the microscopic range and, with increasing duration of the operation, includes larger structures which are rounded and flattened at their surface. As a result, the electropolished surface is characterized by smoothness and closed structure in the micro range and a residual waviness in the macro range which depends on the initial state, the electropolishing duration and the structure of the material.

When manufacturing sawtooth wires for all-steel sawtooth wire card clothings, such an electropolishing process is carried out by winding wire-shaped intermediate products in several layers onto a carrier and immersing the intermediate products for a predetermined time in an electrolyte bath containing a suitable electrolyte in which the electropolishing process is then carried out.

However, it has been found that the sawtooth wires obtained with the conventional methods have a surface property which varies over the length thereof, so that a satisfactory smoothness is not achieved in all areas of the sawtooth wire surfaces.

SUMMARY OF THE INVENTION

In view of these problems in the prior art, it is the primary object of the invention to provide a further development of the known methods by means of which a uniform surface property can be achieved, and an apparatus suitable for carrying out such methods.

With respect to the method, this object is met by a further development of the above-explained method which is essentially characterized in that a relative movement is produced between the electrolyte and the intermediate product during the electropolishing process in the electrolyte bath.

This solution is based on the finding that, in conventional immersion methods in which the wire-shaped intermediate product wound onto a body is immersed in an electrolyte, the electrolyte does not flow uniformly around all portions of the sawtooth wire. This has the result that the treatment does not take place uniformly, especially at the tooth surfaces, wherein, in particular when the wire-shaped intermediate product is wound in several layers onto the carrier, there is not sufficient contact between the electrolyte and the tooth tips in the interior of the resulting "wire ring"; this also leads to an insufficient tooth polishing. When using the further development according to the invention of conventional methods, on the other hand, a uniform treatment for all portions of the wire-shaped intermediate product immersed in the electrolyte bath is achieved, because the relative movement between the electrolyte and the intermediate product has the effect that the electrolyte flows uniformly around this intermediate product which, in turn, results in a uniform and homogenous treatment during the electropolishing process.

As can be gathered from the above explanation of the method according to the invention, the apparatus according to the invention for carrying out this method is essentially characterized in that it includes a device for producing a relative movement between an electrolyte contained in an electrolyte bath and the wire-shaped intermediate product immersed in the electrolyte bath.

It has been found particularly advantageous if the intermediate product is moved in the electrolyte bath during the electropolishing process. For achieving a particularly efficient continuous method, the electropolishing process is carried out by conveying the intermediate product through the electrolyte bath, preferably by pulling the intermediate product through the electrolyte bath by means of a conveying device arranged in the conveying direction of the intermediate product behind the electrolyte bath and acting on the intermediate product. For this purpose, the apparatus according to the invention preferably has a conveying device with two conveyor rollers having roller axes extending parallel to one another, wherein the wire-shaped intermediate product is clamped between these conveyor rollers and is pulled through the electrolyte bath by rotating the conveyor rollers.

When carrying out the continuous electropolishing process according to the invention, a treatment time which is sufficiently long for achieving a satisfactory treatment, while simultaneously ensuring a high processing speed in a relatively small electrolyte bath, can be achieved if the intermediate product is deflected within the electrolyte bath with a suitable deflecting device in order to increase the travel path traveled by the intermediate product in the electrolyte bath. As a result, even if the conveying speed is relatively high, its sufficiently long dwell time within the electrolyte bath is achieved, without excessively increasing the size of the electrolyte bath for this purpose.

It has been found particularly useful it the intermediate product travels essentially helically around a deflecting device arranged within the electrolyte bath and provided with at least one deflecting roller. The dwell time of the wire-shaped intermediate product in the electrolyte bath can be adjusted in dependence on the material properties of the intermediate product, such as the surface property after leaving the electrolyte bath, if the conveying speed is controlled in dependence on these material properties. Moreover, the effectiveness of the electropolishing method according to the invention can be further increased if the direct current intensity of the direct current source coupled anodically to the intermediate product received in the electrolyte bath is controlled in dependence on the material properties of the intermediate product, such as the surface properties after leaving the electrolyte bath.

It has been found particularly useful if the intermediate product is pulled by means of the conveying device from an uncoiling reel and, as traveling through the electrolyte bath, is placed on a coiling reel and is wound onto the coiling reel. For increasing the efficiency of the electropolishing method of the invention it has also been found useful if the intermediate product is initially mechanically cleaned before carrying out the electropolishing process; for this purpose, the intermediate product preferably travels through a stationary cleaning device. This mechanical precleaning can be carried out by means of brushes and/or washing discs and results in the removal of coarse unevenness, such as notches, scratches and marks or substantial burrs which can only be removed with great difficulties by means of an electropolishing process which constitutes a fine or very fine treatment.

The electropolishing process according to the invention is usually carried out with the use of sulfuric acid and phosphoric acid (35–45 %), wherein chromic acid is avoided as much as possible. The electrolyte bath may also contain various additives or brighteners. For ensuring a problem-free further processing of the wire-shaped intermediate product after traveling through the electrolyte bath, it is important that residues of the electrolyte are removed completely from the wire-shaped intermediate product. For this purpose, after carrying out the electropolishing process, the intermediate product is advantageously cleaned; preferably, the intermediate product travels through another stationary cleaning device. This additional stationary cleaning device may have a plurality of cleaning stations, such as water baths, arranged one behind the other in the conveying direction of the intermediate product, in order to achieve a complete cleaning of the intermediate product and to prevent the electrolyte residues from being dragged to other processing stages.

It is also conceivable that, after carrying out the electropolishing process and preferably after traveling through the additional cleaning device, the intermediate product is conserved with a rust protecting agent in an appropriate conserving device; for this purpose, the intermediate product also advantageously travels through the conserving device, in order to obtain a continuously operating method.

As can be gathered from the above explanation of the invention, it is particularly useful if, for carrying out this method, the sawtooth wire is continuously pulled from an uncoiling reel, then travels first through a cleaning device designed for carrying out a mechanical cleaning, subsequently travels through the electrolyte bath, wherein the intermediate product essentially helically revolves through the electrolyte bath in order to achieve a long dwell time, the intermediate product travels after leaving the electrolyte bath through another cleaning device for removing electrolyte residues, then travels through a conserving device, and is then placed on and wound onto a coiling reel, wherein the conveying device required for this purpose is advantageously arranged between the conserving device and the coiling reel and includes two conveyor rollers between which the intermediate product is clamped.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic illustration of an apparatus according to the invention serving for carrying out the method according to the invention.

DESCRIPTION OF THE PREFERRED EMBODIMENTS

The apparatus illustrated in the drawing essentially consists of an uncoiling reel 10 onto which is wound a wire-shaped intermediate product in the form of a wire already provided with sawteeth, a cleaning device 20 designed for carrying out a mechanical cleaning of the intermediate product, an electrolyte bath 30, an additional cleaning device 40 designed for rinsing the intermediate product leaving the electrolyte bath, a conserving device 50, a conveying device 60 and a coiling reel 70.

The conveying device 60 includes two conveyor rollers 62 and 64 which have roller axes extending parallel to each other; the intermediate product is clamped between the conveyor rollers 62 and 64. By rotating the conveyor rollers 62 and 64 in the-directions indicated in the drawing by arrows P, the sawtooth wire 5 is pulled from the uncoiling reel 10 in the direction indicated by arrow P'. After leaving the uncoiling reel 10, the sawtooth wire 5 is initially deflected by means of a deflecting roller 12 into essentially horizontally extending path and is then conducted into the cleaning device 20. In this cleaning device 20, the sawtooth wire is mechanically cleaned by means of two cleaning rollers 22 and 24, wherein brushes and/or washing discs can also be used instead of the cleaning rollers. After leaving the cleaning device 20, the sawtooth wire 5 which continues to be conveyed by the conveying device 60 is conducted into the electrolyte bath 30 arranged in the conveying direction behind the cleaning device 20.

Within the electrolyte bath 30, the sawtooth wire 5 travels essentially helically around two deflecting rollers 33 and 34 which have roller axes extending parallel to each other and are arranged within the electrolyte bath 30.

As the conveying device 60 continues to convey the sawtooth wire 5, the sawtooth wire 5 leaves the electrolyte bath on a horizontal path and is introduced into the additional cleaning device 40 arranged in the conveying direction behind the electrolyte bath 30. This additional cleaning device 40 is composed of four water baths arranged one behind the other in the conveying direction in which the sawtooth wire is rinsed for removing electrolyte residues, wherein the contamination of the individual water baths decreases in the conveying direction so that a particularly effective cascade cleaning is achieved with the additional cleaning device 40.

After leaving the additional cleaning device 40, the sawtooth wire 5 which continues to be conveyed by the conveying device 60 is conveyed into the conserving device 50 where it is conserved with a rust protecting agent. Following this conserving device 50, the sawtooth wire travels through the conveying device 60 and is then wound onto the coiling reel 70.

Within the electrolyte bath 30, the sawtooth wire 5 is anodically coupled to an externally controllable direct current source (not shown), wherein the intensity of the direct current in the electrolyte bath is controlled in dependence on the surface properties of the sawtooth wire in order to ensure an optimum treatment of the sawtooth wire within the electrolyte bath. The work temperature of the bath is about 70° C. to 580° C. during the electropolishing process. Prepared as the electrolyte is a chromic acid-free aqueous solution of sulfuric acid and phosphoric acid (35–45%) which may contain additional additives, particularly brighteners. The volume of the bath is 600 l. The control of the electrolyte bath is effected through a density determination, wherein the density advantageously monitored by a density spindle preferably is about 1.78 kg/l, wherein an iron content of 3 g/l is already taken into consideration. For controlling the properties of the electrolyte bath, electrolyte can be added to the bath or the bath can be diluted by means of water. In a conventional production process, 10 to 20 l water are added to the electrolyte per week, wherein a partial exchange of the bath of 30 to 40 l takes place once a week.

The invention is not limited to the embodiment explained with the aid of the drawing. Rather, the electrolyte bath may also have a different type of deflecting device. Moreover, the additional cleaning device may have more or fewer than four cleaning baths. It is also conceivable to convey the sawtooth wire along a differently extending path through the apparatus according to the invention.

While specific embodiments of the invention have been shown and described in detail to illustrate the inventive principles, it will be understood that the invention may be embodied otherwise without departing from such principles.

I claim:

1. A method of manufacturing a sawtooth wire for all-steel sawtooth wire card clothings, the method comprising smoothing a surface of a wire-shaped intermediate product in an electropolishing process in an electrolyte bath containing an electrolyte, further comprising producing a relative movement between the electrolyte and the intermediate product during the electropolishing process, moving the intermediate product in the electrolyte during the electropolishing process, and deflecting the intermediate product essentially helically around a deflecting device arranged within the electrolyte bath.

2. The method according to claim 1, comprising conveying the intermediate product through the electrolyte bath.

3. The method according to claim 2, comprising pulling the intermediate product through the electrolyte bath by a conveying device arranged in a conveying direction of the intermediate product behind the electrolyte bath and acting on the intermediate product.

4. The method according to claim 3, comprising pulling the intermediate product from an uncoiling reel by the conveying device, and placing the intermediate product on a coiling reel after traveling through the electrolyte bath.

5. The method according to claim 2, comprising controlling a conveying speed of the intermediate product through the electrolyte bath in dependence on material properties of the intermediate product after leaving the electrolyte bath.

6. The method according to claim 1, comprising anodically coupling the intermediate product in the electrolyte bath to a direct current source, and controlling an intensity of the direct current in dependence on the material properties of the intermediate product.

7. The method according to claim 1, comprising mechanically cleaning the intermediate product prior to the electropolishing process.

8. The method according to claim 7, comprising conveying the intermediate product through a stationary cleaning device.

9. The method according to claim 1, comprising cleaning the intermediate product after the electropolishing process.

10. The method according to claim 9, comprising conveying the intermediate product through an additional stationary cleaning device.

11. The method according to claim 1, comprising conserving the intermediate product with a rust protecting agent after the electropolishing process.

12. The method according to claim 11, comprising conveying the intermediate product through a conserving device.

13. An apparatus for manufacturing a sawtooth wire for all-steel sawtooth wire card clothings, wherein a surface of a wire-shaped intermediate product is smoothened in an electropolishing process, the apparatus comprising an electrolyte bath containing an electrolyte for electrolytically smoothening the wire-shaped intermediate product, the apparatus further comprising a device for producing a relative movement between the electrolyte and the intermediate product in the electrolyte bath, a deflecting device mounted in the electrolyte bath, wherein the deflecting device comprises at least one deflecting roller configured such that the intermediate product is essentially helically conducted around the deflecting rollers.

14. The apparatus according to claim 13, wherein the device for producing the relative movement comprises a conveying device for conveying the intermediate product through the electrolyte bath.

15. The apparatus according to claim 14, wherein the conveying device is configured to convey the intermediate product in a conveying direction, and wherein the conveying device is arranged in the conveying direction following the electrolyte bath for pulling the intermediate product through the electrolyte bath.

16. The apparatus according to claim 13, comprising a cleaning device for cleaning the intermediate product before the electrolytic smoothening.

17. The apparatus according to claim 13, comprising an additional cleaning device for cleaning the intermediate product after the electrolytic smoothening.

18. The apparatus according to claim 17, wherein the additional cleaning device comprises a plurality of cleaning stations.

19. The apparatus according to claim 18, wherein the cleaning stations are water baths arranged one behind the other in a conveying direction of the intermediate product.

20. An apparatus for manufacturing a sawtooth wire for all-steel sawtooth wire card clothings, wherein a surface of a wire-shaped intermediate product is smoothened in an electropolishing process, the apparatus comprising an electrolyte bath containing an electrolyte for electrolytically smoothening the wire-shaped intermediate product, the apparatus further comprising a device for producing a relative movement between the electrolyte and the intermediate product in the electrolyte bath and a device for conserving the elctrolytically smoothened intermediate product by a rust protecting agent.

* * * * *